US010677077B2

(12) United States Patent
Taguchi et al.

(10) Patent No.: US 10,677,077 B2
(45) Date of Patent: Jun. 9, 2020

(54) TURBINE NOZZLE AND RADIAL TURBINE INCLUDING THE SAME

(71) Applicant: Panasonic Corporation, Osaka (JP)

(72) Inventors: Hidetoshi Taguchi, Osaka (JP); Osao Kido, Kyoto (JP); Fumitoshi Nishiwaki, Hyogo (JP); Yoshitsugu Nishiyama, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 67 days.

(21) Appl. No.: 15/895,104

(22) Filed: Feb. 13, 2018

(65) Prior Publication Data

US 2018/0252112 A1 Sep. 6, 2018

(30) Foreign Application Priority Data

Mar. 1, 2017 (JP) ..... 2017-038474
Mar. 1, 2017 (JP) ..... 2017-038477

(51) Int. Cl.
*F01D 9/04* (2006.01)

(52) U.S. Cl.
CPC ..... *F01D 9/041* (2013.01); *F01D 9/045* (2013.01); *F05D 2240/128* (2013.01)

(58) Field of Classification Search
None
See application file for complete search history.

(56) References Cited

U.S. PATENT DOCUMENTS 3,804,335 A * 4/1974 Sohre ..... F01D 1/04 239/289
3,968,935 A * 7/1976 Sohre ..... F01D 9/02 239/289
5,676,522 A 10/1997 Pommel et al.
2008/0092515 A1 4/2008 Yagi et al.

FOREIGN PATENT DOCUMENTS

FR 2230861 A1 12/1974
JP 2010-190109 9/2010
WO 2005/085615 9/2005

OTHER PUBLICATIONS

The Extended European Search Report dated Jun. 11, 2018 for the related European Patent Application No. 18158388.1.
J. Conrad Crown, "National Advisory Committee for Aeronautics", Technical Note, No. 1651, Supersonic Nozzle Design, Jun. 1948.

* cited by examiner

*Primary Examiner* — Christopher Verdier
*Assistant Examiner* — Jason A Fountain
(74) *Attorney, Agent, or Firm* — McDermott Will & Emery LLP

(57) ABSTRACT

A turbine nozzle according to the disclosure is a turbine nozzle that is used in a radial turbine and includes a ring-shaped hub, a plurality of nozzle vanes that are arranged at equal angular intervals on the hub, and a flow path that is formed between the nozzle vanes. The flow path includes a throat that has a smallest flow path cross-sectional area with respect to a flow direction of working fluid. On a downstream side of the throat with respect to the flow direction, the flow path cross-sectional area increases. Heights of the nozzle vanes on the downstream side of the throat with respect to the flow direction are greater than heights of the nozzle vanes in the throat and gradually increase from an upstream side toward the downstream side with respect to the flow direction.

6 Claims, 14 Drawing Sheets

TURBINE NOZZLE AND RADIAL TURBINE INCLUDING THE SAME

BACKGROUND

1. Technical Field

The present disclosure relates to a turbine nozzle and a radial turbine including the same.

2. Description of the Related Art

Turbines are used for a purpose of deriving power from compressible working fluid such as air. Types of turbine primarily include axial-flow turbine and radial turbine. In general, the radial turbine excels the axial-flow turbine in efficiency in a single stage. Therefore, the radial turbine is suitable for small-to-medium-scale power generating installations, for instance.

One of important components of the radial turbine is a turbine nozzle. The turbine nozzle is a component that is intended for guiding working fluid to a turbine wheel and assumes a role of converting a pressure into a velocity by expanding the working fluid. In a radial turbine, as disclosed in International Publication No. 2005/085615, a plurality of turbine vanes that configure the turbine nozzle are circularly arranged around the turbine wheel. Flow paths for the working fluid are formed of spaces between the turbine vanes that adjoin along a circumferential direction of the turbine wheel. Commonly, flow path cross-sectional areas gradually decrease from an upstream side toward a downstream side (that is, toward the turbine wheel) in order that the working fluid may be expanded.

When passing through the turbine nozzle, the working fluid expands in accordance with a pressure in the turbine nozzle and increases in velocity. The turbine wheel is rotated by impulses that are exerted on blades of the turbine wheel when the working fluid collides against the blades and by reactions that are exerted on the blades of the turbine wheel by the working fluid that expands when passing through flow paths between the blades (so-called impulse reaction turbine). A generator connected to the turbine wheel is thereby rotated so as to generate electric power.

Japanese Unexamined Patent Application Publication No. 2010-190109 discloses a tapered nozzle that is intended for speeding up working fluid for a purpose of increasing output power of an impulse turbine.

SUMMARY

One method for increasing an efficiency of the radial turbine is to increase an expansion ratio of fluid in the radial turbine. The radial turbine in which tapered nozzles are used, however, is incapable of expanding working fluid by a pressure ratio (expansion ratio) exceeding a critical pressure ratio. The "critical pressure ratio" means a pressure ratio at time when a flow velocity of the working fluid reaches a velocity of sound.

One non-limiting and exemplary embodiment provides a technique that is intended for expanding working fluid by a high pressure ratio exceeding the critical pressure ratio.

In one general aspect, the techniques disclosed here feature a turbine nozzle that is used in a radial turbine, the turbine nozzle including a ring-shaped hub that has a central axis, a plurality of nozzle vanes that are arranged at equal angular intervals on the hub along a circumferential direction of the hub and that include a first nozzle vane and a second nozzle vane which adjoin along the circumferential direction of the hub, and a flow path that is formed between a ventral surface of the first nozzle vane and a back surface of the second nozzle vane, in which, provided that a direction from an outer peripheral side of the hub toward an inner peripheral side of the hub is defined as a flow direction of working fluid in the flow path, the flow path includes a throat that has a smallest flow path cross-sectional area with respect to the flow direction, the flow path cross-sectional area increases on a downstream side of the throat with respect to the flow direction, and heights of the first nozzle vane on the downstream side of the throat with respect to the flow direction are greater than heights of the first nozzle vane in the throat and gradually increase from an upstream side toward the downstream side with respect to the flow direction.

According to the techniques of the disclosure, the working fluid can be expanded by a high pressure ratio exceeding the critical pressure ratio.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Figure 1:
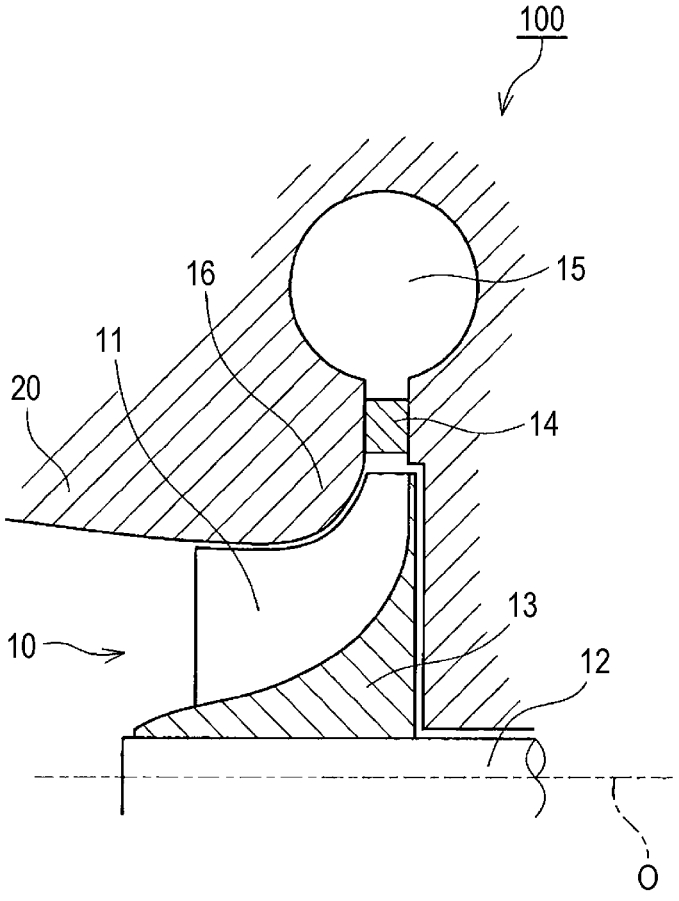
FIG. 1 is a fragmentary sectional view of a radial turbine according to an embodiment of the disclosure.

DETAILED DESCRIPTION (Underlying Knowledge Forming Basis of the Present Disclosure)

On an assumption that working fluid is ideal fluid, a flow velocity of the working fluid at an outlet of a nozzle is expressed by following equation (1):

$$C_s = 2 \cdot C_p \cdot T_{01} \cdot \sqrt{(1 - P_{exit}/P_{00})^{\left(\frac{\kappa}{\kappa-1}\right)}} \quad (1)$$

where $C_s$ is a discharge flow velocity,
$C_p$ is specific heat at constant pressure,
$T_{01}$ is a static temperature at a throat,
$P_{exit}$ is a static pressure at the outlet of the nozzle,
$P_{00}$ is a static pressure at an inlet of the nozzle, and
κ is a ratio of specific heat.

The discharge flow velocity $C_s$ is determined in accordance with a pressure ratio $P_{exit}/P_{00}$ up to a maximum of a velocity of sound that is determined in accordance with physical properties and quantities of state of the working fluid. A pressure ratio with which the discharge flow velocity $C_s$ reaches the velocity of sound is referred to as "critical pressure ratio". Common nozzles such as tapered nozzles are incapable of expanding working fluid by a pressure ratio equal to or greater than the critical pressure ratio. That is, expansion with which the flow velocity of the working fluid exceeds the velocity of sound is unattainable therein.

Subsequently, a value M defined by following equation (2) is referred to as Mach number. The Mach number is obtained by division of the flow velocity by the velocity of sound.

$$M = V/a = V/\sqrt{\kappa \cdot R \cdot T_{00}} \quad (2)$$

where M is the Mach number,
V is the flow velocity of the working fluid,
a is the velocity of sound,
κ is the ratio of specific heat,
R is a gas constant of the working fluid, and
$T_{00}$ is a static temperature of the working fluid.

In a tapered nozzle, the flow velocity is maximized in a portion where a flow path cross-sectional area thereof is minimized. When the maximum flow velocity reaches M=1, the expansion ratio in the tapered nozzle reaches the critical pressure ratio, so that the working fluid may not be allowed to expand any more. A relationship of following equation (3) holds between the flow path cross-sectional area and the Mach number M.

$$A/A^* = 1/M \cdot \left[1 + \left(\frac{\kappa - 1}{\kappa}\right) M^2 \Big/ \left(\frac{\kappa + 1}{2}\right)\right]^{\frac{\kappa+1}{2\cdot(\kappa-1)}} \quad (3)$$

where A is the flow path cross-sectional area at a desired position in the nozzle,
A* is the smallest flow path cross-sectional area in the nozzle,
M is the Mach number, and
κ is the ratio of specific heat.

Figure 7:
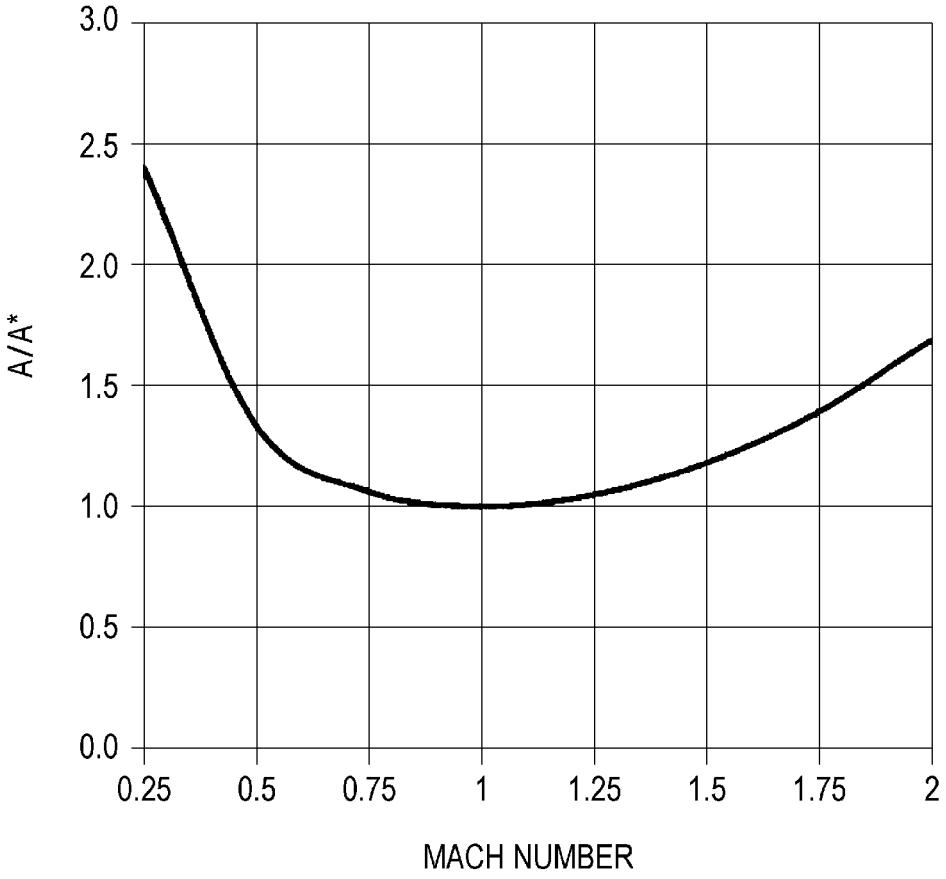
FIG. 7 is a graph illustrating calculation results of equation (3) under a condition that working fluid is standard air ($\kappa = 1.4$)

FIG. 7 illustrates calculation results of equation (3) under a condition that the working fluid is standard air (κ=1.4). At a desired position in the nozzle where the Mach number M of flow is smaller than 1, as comprehensible from equation (3) and FIG. 7, it is necessary for the nozzle to have a cross-sectional area greater than the smallest flow path cross-sectional area (that is, the cross-sectional area at time of M=1). The flow path cross-sectional area decreases with increase in the flow velocity and the flow velocity reaches the velocity of sound at a position where the flow path cross-sectional area is minimized. When the flow velocity exceeds the velocity of sound, the flow path cross-sectional area increases. That is, it is necessary to increase the flow path cross-sectional area in order to increase the flow velocity beyond the velocity of sound.

As comprehensible from these facts, a nozzle that includes a portion having a tapered shape, a portion (throat) having the smallest flow path cross-sectional area, and a portion having a divergent shape is demanded in order to change the flow velocity from subsonic flow to supersonic flow. Nozzles with such a structure are referred to as "Laval nozzles" and are used in propulsion engines such as engines of rockets or aircrafts in which the supersonic flow is frequently used.

In Japanese Unexamined Patent Application Publication No. 2010-190109, the tapered nozzle that is intended for speeding up the working fluid to be guided to the turbine wheel of the impulse turbine is used for the purpose of increasing the output power of the impulse turbine. The impulse turbine is configured to expand the working fluid substantially completely by the nozzle and to rotate the turbine wheel by impulses that are exerted on blades of the turbine wheel when the working fluid collides against the blades. A structure in which the tapered nozzles disclosed in Japanese Unexamined Patent Application Publication No. 2010-190109 are arranged tangentially with respect to the turbine wheel is often employed for turbines that operate under conditions of low flow rate and high pressure ratio. In the structure, however, lengthiness of nozzle parts makes overall dimensions of the turbine excessively large. The nozzle disclosed in Japanese Unexamined Patent Application Publication No. 2010-190109 has the smallest flow path cross-sectional area at a tip of the nozzle. In the nozzle disclosed in Japanese Unexamined Patent Application Publication No. 2010-190109, therefore, the Mach number M does not exceed 1 and acceleration that makes the Mach number exceed 1 is unattainable.

U.S. Pat. No. 5,676,522 discloses a supersonic distributor for an axial-flow turbine. In the supersonic distributor of U.S. Pat. No. 5,676,522, an outer shape of a blade element (vane) has an upstream linear portion, a projecting portion that forms a throat, and a downstream curved portion. It is stated in U.S. Pat. No. 5,676,522 that a supersonic flow having a Mach number in a range from 1.2 to 2.5 can be generated. The supersonic distributor disclosed in U.S. Pat. No. 5,676,522 is similar to the Laval nozzle. A two-dimensional shape of each flow path formed between the adjoining vanes, however, is inevitably asymmetrical with respect to a center line of the flow path due to constraints on a structure of the distributor.

As disclosed in FIG. 1 in NACA TECHNICAL NOTE No. 1651 SUPERSONIC NOZZLE DESIGN, by contrast, an ideal Laval nozzle is axisymmetric. In such an axisymmetric structure, shock waves that occur after passage through the throat are cancelled out by being reflected on facing wall surfaces, so that sharp pressure change can be curbed (FIGS. 8 and 9 in NACA TECHNICAL NOTE No. 1651 SUPERSONIC NOZZLE DESIGN). As a result, the supersonic flow may be efficiently generated.

On condition that the flow paths have no symmetrical structure, as in the distributor of U.S. Pat. No. 5,676,522, an effect of cancelling out the shock waves may be insufficiently obtained and such disturbances in a flow field as bloating and separation of a boundary layer tend to occur additionally. Consequently, expansion in excess of a high transonic range on the order of M=1.1 to 1.2 may be unattainable in most cases. That is, additional contrivance is demanded in case where expansion up to a higher ultrasonic range is requisite.

A turbine nozzle according to a first aspect of the disclosure is a turbine nozzle that is used in a radial turbine and includes a ring-shaped hub that has a central axis, a plurality of nozzle vanes that are arranged at equal angular intervals on the hub along a circumferential direction of the hub and that include a first nozzle vane and a second nozzle vane which adjoin along the circumferential direction of the hub, and a flow path that is formed between a ventral surface of the first nozzle vane and a back surface of the second nozzle vane, provided that a direction from an outer peripheral side of the hub toward an inner peripheral side of the hub is defined as a flow direction of working fluid in the flow path, the flow path includes a throat that has a smallest flow path cross-sectional area with respect to the flow direction, the flow path cross-sectional area increases on a downstream side of the throat with respect to the flow direction, and heights of the first nozzle vane on the downstream side of the throat with respect to the flow direction are greater than heights of the first nozzle vane in the throat and gradually increase from an upstream side toward the downstream side with respect to the flow direction.

According to the turbine nozzle of the first aspect, effects obtained from the Laval nozzle, such as the effect of cancelling out the shock waves, are enhanced. As a result, the expansion by a higher pressure ratio can be attained. Even after the Mach number M of the flow velocity of the working fluid reaches 1 at the throat, the working fluid may continue increasing in velocity, that is, expanding. Thus an impulse component that rotates the turbine wheel is increased because the working fluid having a higher velocity can be introduced into the turbine wheel in comparison with a turbine nozzle in which a simple tapered nozzle is used and, consequently, the radial turbine capable of generating large output power in a single stage can be constructed.

In a second aspect of the disclosure, in the turbine nozzle according to the first aspect, for instance, a top surface of the hub on the downstream side of the throat with respect to the flow direction is perpendicular to the central axis and a top surface of the first nozzle vane on the downstream side of the throat with respect to the flow direction is sloped relative to a plane perpendicular to the central axis. According to the second aspect, machining for production of the turbine nozzle is facilitated.

In a third aspect of the disclosure, in the turbine nozzle according to the first aspect, for instance, the top surface of the first nozzle vane on the downstream side of the throat with respect to the flow direction is perpendicular to the central axis and the top surface of the hub on the downstream side of the throat with respect to the flow direction is sloped relative to a plane perpendicular to the central axis. According to the third aspect, the top surface of the first nozzle vane is parallel to a plane perpendicular to the central axis of the hub and thus a dimension of a clearance between the first nozzle vane and a shroud wall of the radial turbine can be easily adjusted. That is, it is not requisite to modify a shape of the shroud wall and increase in production costs for the turbine nozzle can be reduced.

In a fourth aspect of the disclosure, in the turbine nozzle according to the first aspect, for instance, the top surface of the first nozzle vane on the downstream side of the throat with respect to the flow direction is sloped relative to a plane perpendicular to the central axis and the top surface of the hub on the downstream side of the throat with respect to the flow direction is sloped relative to the plane perpendicular to the central axis. According to the fourth aspect, a slope angle of the top surface of the first nozzle vane and a slope angle of the top surface of the hub can be decreased.

In a fifth aspect of the disclosure, an airfoil center line of each of the plurality of nozzle vanes in the turbine nozzle according to the first aspect, for instance, includes a first portion and a second portion, the first portion is a portion that extends from an upstream end of the airfoil center line to a first point, the first point is a point where the airfoil center line starts to curve in a direction toward the central axis, and the second portion is a portion that extends from the first point to a downstream end of the airfoil center line.

According to the fifth aspect, directions of shock waves that are generated on a trailing edge portion of each of the plurality of nozzle vanes when the flow velocity of the working fluid reaches a supersonic velocity can be deflected toward the downstream side with respect to the flow direction. Thus a high expansion ratio can be attained by a shift of pressure recovery positions resulting from the shock waves toward the downstream side and by enlargement of a region of expansion waves generated prior to generation of the shock waves (that is, an expansion region in which the flow velocity continues increasing). Additionally, an appropriate inlet angle of the working fluid from the turbine nozzle into the turbine wheel can be maintained.

In a sixth aspect of the disclosure, provided that an angle between a plane including the central axis and the airfoil center line in the turbine nozzle according to the fifth aspect, for instance, is defined as an angle $\beta$, average rates of change in the angle $\beta$ in the first portion are positive values, the second portion includes a second point where the average rates of change in the angle $\beta$ change from positive values to negative values, and the average rates of change in the angle $\beta$ in a section from the second point to the downstream end are negative values. According to the sixth aspect, uniformity in a distribution of discharge velocities with respect to a width direction of the nozzle vane is heightened. Thus fluctuations in angular velocity (torque fluctuations) per one revolution of the turbine wheel are reduced, so that high-quality AC power can be generated by a generator connected to the radial turbine.

In a seventh aspect of the disclosure, provided that the angle between a plane including the central axis and the airfoil center line in the turbine nozzle according to the fifth or sixth aspect, for instance, is defined as the angle $\beta$, the angle $\beta$ linearly changes in a section in the second portion that includes the downstream end and that has a specified length.

A radial turbine according to an eighth aspect of the disclosure includes the turbine nozzle according to any one of the first to seventh aspects, and a turbine wheel that is placed on inside of the turbine nozzle.

According to the eighth aspect, the radial turbine capable of generating large output power in the single stage can be provided.

Hereinbelow, embodiments of the disclosure will be described with reference to the drawings. The disclosure is not limited to the embodiments that will be described below.

As illustrated in FIG. 1, a radial turbine 100 according to the embodiment includes a turbine wheel 10, a shaft 12, a turbine nozzle 14, and a casing 20. The turbine wheel 10 and the turbine nozzle 14 are placed in the casing 20. The turbine wheel 10 is placed on inside of the turbine nozzle 14. The shaft 12 is fixed to the turbine wheel 10. The turbine wheel 10 includes a plurality of rotor blades 11 and a hub 13. The plurality of rotor blades 11 are provided at equal angular intervals on a surface of the hub 13. The casing 20 includes a scroll chamber 15 and a shroud wall 16. The scroll chamber 15 is an annular space formed around the turbine nozzle 14. An inlet port (illustration is omitted) provided on the casing 20 opens onto the scroll chamber 15. Working fluid is guided from the scroll chamber 15 through the turbine nozzle 14 to the turbine wheel 10. The shroud wall 16 covers the rotor blades 11 and the turbine nozzle 14 from one side with respect to a direction parallel to an axis O of rotation common to the turbine wheel 10 and the shaft 12. The axis O of rotation coincides with a central axis of the turbine nozzle 14. Therefore, the central axis of the turbine nozzle 14 is also described herein as "central axis O".

Figure 2:
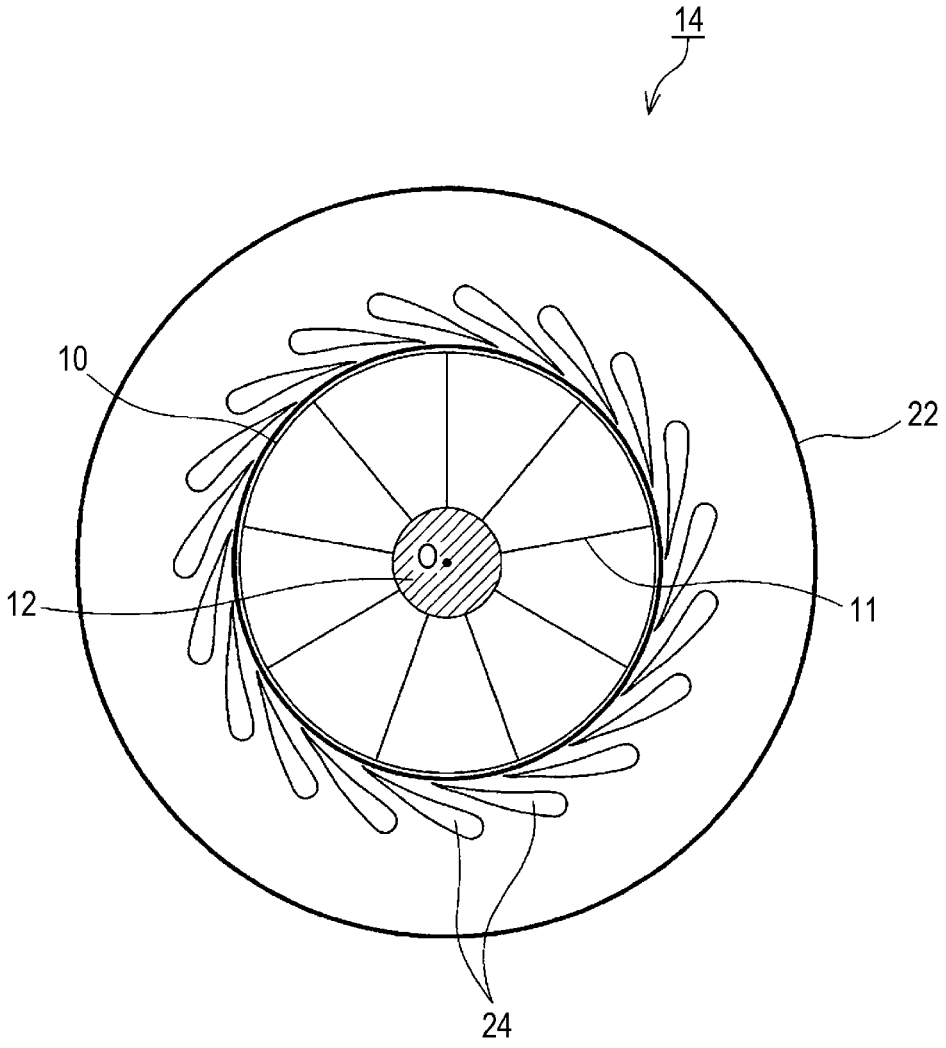
FIG. 2 is a fragmentary plan view of the radial turbine illustrated in FIG. 1.

As illustrated in FIG. 2, the turbine nozzle 14 is composed of a hub 22 and a plurality of nozzle vanes 24. The hub 22 is a component shaped like a ring and shaped like a plate. The hub 22 has a circular inner perimeter and a circular outer perimeter in plan view. The plurality of nozzle vanes 24 are arranged at equal angular intervals on the hub 22 along a circumferential direction of the hub 22.

The radial turbine 100 of the embodiment is a so-called impulse reaction turbine. In general, it is difficult for a turbine nozzle in which nozzle vanes are used to attain expansion by a high pressure ratio because individual flow paths have comparatively short lengths. In the impulse reaction turbine, however, working fluid can be primarily expanded in the turbine nozzle and can be further expanded in the turbine wheel. The expansion of the working fluid is divided between the turbine nozzle and the turbine wheel and thus a flow velocity of the working fluid in each resists becoming excessively high. As a result, friction loss and disturbances in flow that are dominated by the flow velocity can be reduced and the impulse reaction turbine is thus prone to attain higher efficiency than the impulse turbine.

Figure 3:
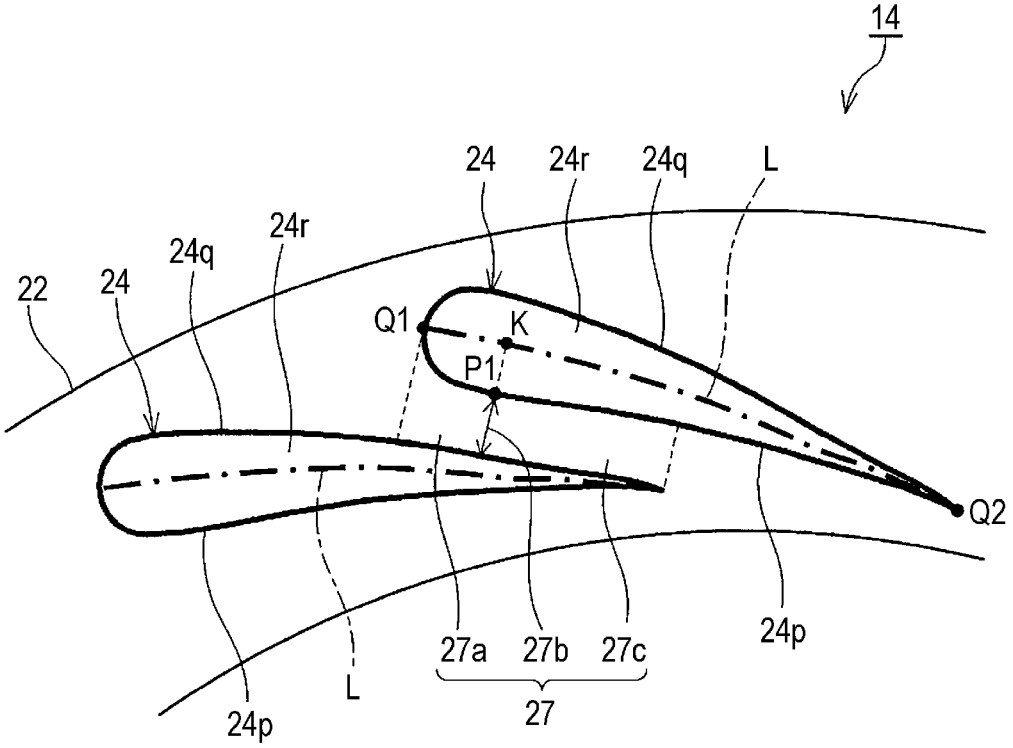
FIG. 3 is an enlarged fragmentary plan view of a turbine nozzle.

As illustrated in FIG. 3, each nozzle vane 24 has a ventral surface 24*p*, a back surface 24*q*, and a top surface 24*r*. The ventral surface 24*p* is a surface on a side that is the nearer to the central axis O of the hub 22. The back surface 24*q* is a surface on a side that is the farther from the central axis O of the hub 22. In other words, the ventral surface 24*p* is the surface on a side that is the nearer to the turbine wheel 10 and the back surface 24*q* is the surface on a side that is the farther from the turbine wheel 10. The top surface 24*r* is a surface that faces the shroud wall 16 (see FIG. 1). The nozzle vane 24 has a columnar shape as a whole. In two nozzle vanes 24 that adjoin along the circumferential direction of the hub 22, a flow path 27 for the working fluid is formed between the ventral surface 24*p* of one nozzle vane 24 (first nozzle vane) and the back surface 24*q* of the other nozzle vane 24 (second nozzle vane).

In the embodiment, the flow path 27 has a contracting portion 27*a*, a throat 27*b*, and a divergent portion 27*c*. Provided that a direction from an outer peripheral side of the hub 22 toward an inner peripheral side of the hub 22 is defined as a flow direction of the working fluid in the flow path 27, the contracting portion 27*a*, the throat 27*b*, and the divergent portion 27*c* are arranged in order of mention from an upstream side with respect to the flow direction. The contracting portion 27*a* is a portion that is located upstream of the throat 27*b* with respect to the flow direction and that has flow path cross-sectional areas gradually decreasing. The throat 27*b* is a portion that has the smallest flow path cross-sectional area. The throat 27*b* may have a certain length along the flow direction. That is, a section that has the smallest flow path cross-sectional area may exist in the flow path 27. The divergent portion 27*c* is a portion that is located downstream of the throat 27*b* with respect to the flow direction and that has flow path cross-sectional areas gradually increasing. That is, the turbine nozzle 14 of the embodiment has a structure similar to a structure of the Laval nozzle.

Figure 4:
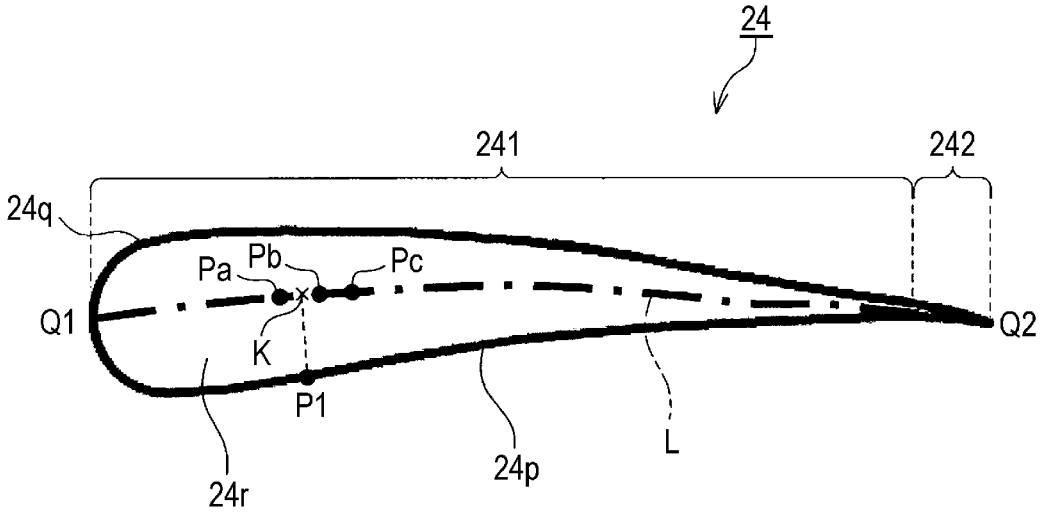
FIG. 4 is an enlarged plan view of a nozzle vane.

In a plan view of the turbine nozzle 14, as illustrated in FIGS. 3 and 4, a position on the ventral surface 24*p* of the nozzle vane 24 that corresponds to the throat 27*b* is defined as a specified position P1. A position that is on an airfoil center line L of the nozzle vane 24 and that is at a distance of a % of an overall length of the airfoil center line L from an upstream end Q 1 toward a downstream end Q2 of the airfoil center line L is defined as a position Pa. A position that is on the airfoil center line L and that is at a distance of b % of the overall length of the airfoil center line L from the upstream end Q1 toward the downstream end Q2 of the airfoil center line L is defined as a position Pb (a<b). An intersection K of a line that is perpendicular to the airfoil center line L and that is drawn from the specified position P1 and the airfoil center line L exists between the position Pa and the position Pb. In an example, settings of a=20 and b=25 are made.

By existence of the throat 27*b* at such a position as described above, sharp decrease in the flow path cross-sectional area in the contracting portion 27*a* can be avoided. As a result, excessive acceleration of the working fluid in the contracting portion 27*a* can be avoided. On condition that the working fluid having a high viscosity is used, in particular, the flow path cross-sectional areas in the contracting portion 27*a* may be made to match design intent and occurrence of a choke of flow in the contracting portion 27*a* can be avoided. In addition, sufficient expansion can be attained because a sufficient length of the divergent portion 27*c* that induces the supersonic flow is ensured.

According to the turbine nozzle 14 of the embodiment, the expansion by a pressure ratio exceeding the critical pressure ratio can be attained in cases where the expansion by a ratio exceeding the critical pressure ratio is demanded and/or where the velocity of sound in the working fluid is low. As a result, large output power can be obtained by the single radial turbine 100. The velocity of sound in the working fluid is lowered under conditions of a low temperature of the working fluid at an inlet of the turbine, a large molecular weight of the working fluid, and/or the like.

Herein, the "airfoil center line L" can be determined by a following method. Initially, a plan view of the nozzle vane 24 is prepared and a chord direction is determined. The chord direction is determined as a direction along which the largest chord length can be ensured. Subsequently, a plurality of parting lines perpendicular to the chord direction are drawn so as to divide the nozzle vane 24 into a plurality of portions lined up along the chord direction. The airfoil center line L is obtained by connection of middle points of the parting lines. The more minutely the parting lines are drawn, the more accurate airfoil center line L can be obtained. A thickness of the nozzle vane 24 is determined as a length of a line segment that passes through a desired point on the airfoil center line L and that connects the ventral surface 24*p* and the back surface 24*q* at the shortest distance.

Figure 5:
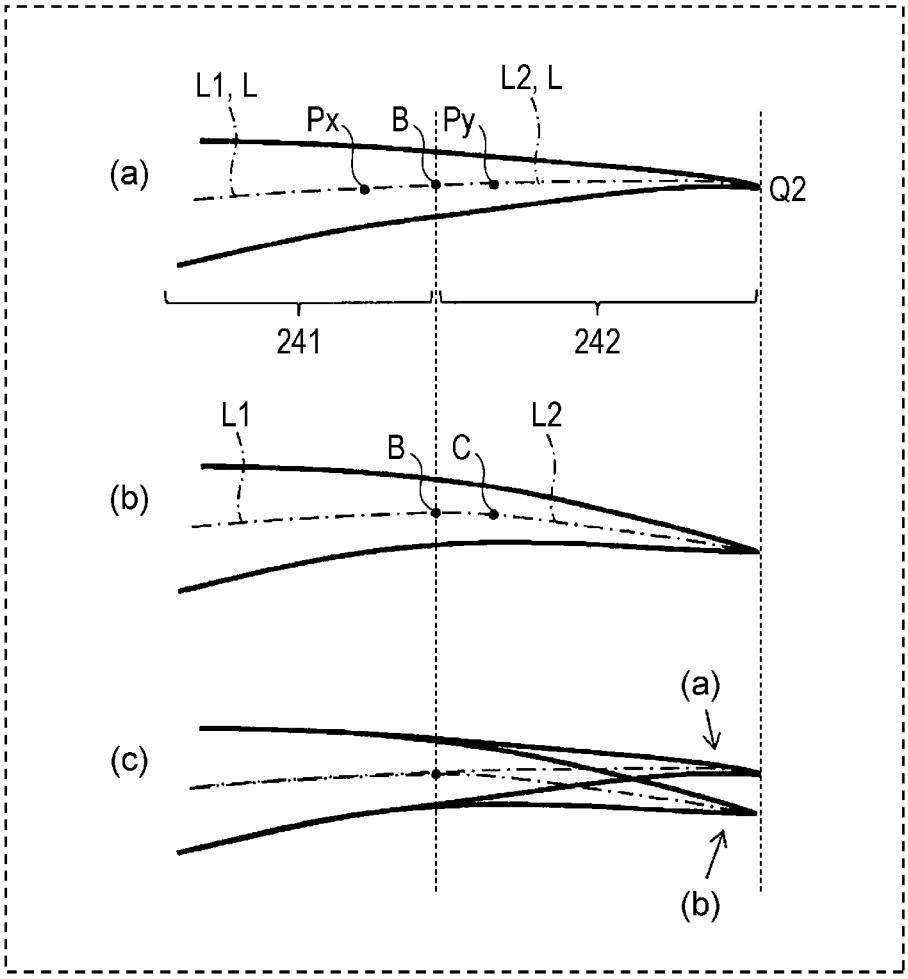
FIG. 5 is an enlarged plan view of trailing edge portions of two nozzle vanes.

As illustrated in FIGS. 4 and 5(*a*), the nozzle vane 24 has a main portion 241 and a trailing edge portion 242. The trailing edge portion 242 is a portion that includes the downstream end Q2 of the airfoil center line L and that is curved toward the central axis O of the hub 22. The main portion 241 is a portion that includes the upstream end Q1 of the airfoil center line L and that is located nearer to the upstream end Q1 of the airfoil center line L than the trailing edge portion 242 is. As illustrated in FIG. 5(*a*), the airfoil center line L of the nozzle vane 24 includes a first portion L1 and a second portion L2. The first portion L1 is a portion that extends from the upstream end Q1 of the airfoil center line L to a first point B. The first point B is a point where the airfoil center line L starts to curve in a direction toward the central axis O. The second portion L2 is a portion that extends from the first point B to the downstream end Q2 of the airfoil center line L. In the embodiment, the first point B is a boundary point on the airfoil center line L between the trailing edge portion 242 and the main portion 241. According to such a structure, the directions of the shock waves that are generated on the trailing edge portion 242 when the flow velocity of the working fluid reaches a supersonic velocity can be deflected toward the downstream side with respect to the flow direction. Thus a high expansion ratio can be attained by the shift of the pressure recovery positions resulting from the shock waves toward the downstream side and the enlargement of the region of the expansion waves generated prior to the generation of the shock waves (that is, the expansion region in which the flow velocity continues increasing). Additionally, an appropriate inlet angle of the working fluid from the turbine nozzle 14 into the turbine wheel 10 can be maintained.

In the Laval nozzle or a nozzle similar to the Laval nozzle that is intended to expand the working fluid by a high pressure ratio, the region of the expansion waves tends to be terminated by the shock waves (pressure waves) that are generated on a trailing edge portion of the nozzle vane. According to the embodiment, by contrast, the region of the expansion waves can be enlarged to the downstream side of the trailing edge portion 242 of the nozzle vane 24. Accordingly, the working fluid can be expanded by a higher pressure ratio. Thus the working fluid having a higher flow velocity flows from the turbine nozzle 14 into the turbine wheel 10. Then an impulse force that drives the turbine wheel 10 is increased, so that the output power of the radial turbine 100 is increased. By smoothing of a flow velocity distribution in each flow path 27, furthermore, the fluctuations in the angular velocity (torque fluctuations) per one revolution of the turbine wheel 10 are reduced, so that a waveform of generated AC power nears a sine waveform. That is, high-quality power is obtained. The working fluid is guided at the appropriate angle from the turbine nozzle 14 toward the turbine wheel 10 and thus isentropic efficiency for the radial turbine 100 is increased.

As illustrated in FIG. 5(*a*), a position that is on the airfoil center line L and that is at a distance of x % of the overall length of the airfoil center line L from the upstream end Q1 toward the downstream end Q2 of the airfoil center line L is defined as a position Px. Similarly, a position that is on the airfoil center line L and that is at a distance of y % of the overall length of the airfoil center line L from the upstream end Q1 toward the downstream end Q2 of the airfoil center line L is defined as a position Py ($b<x<y$). The boundary point B on the airfoil center line L between the trailing edge portion 242 and the main portion 241 exists between the position Px and the position Py, for instance. In an example, settings of x=85 and y=90 are made. According to such a structure, the enlarged expansion region can be formed without inhibition of the expansion in the divergent portion 27*c*. Thus the output power of the radial turbine 100 is increased.

Figure 8A:
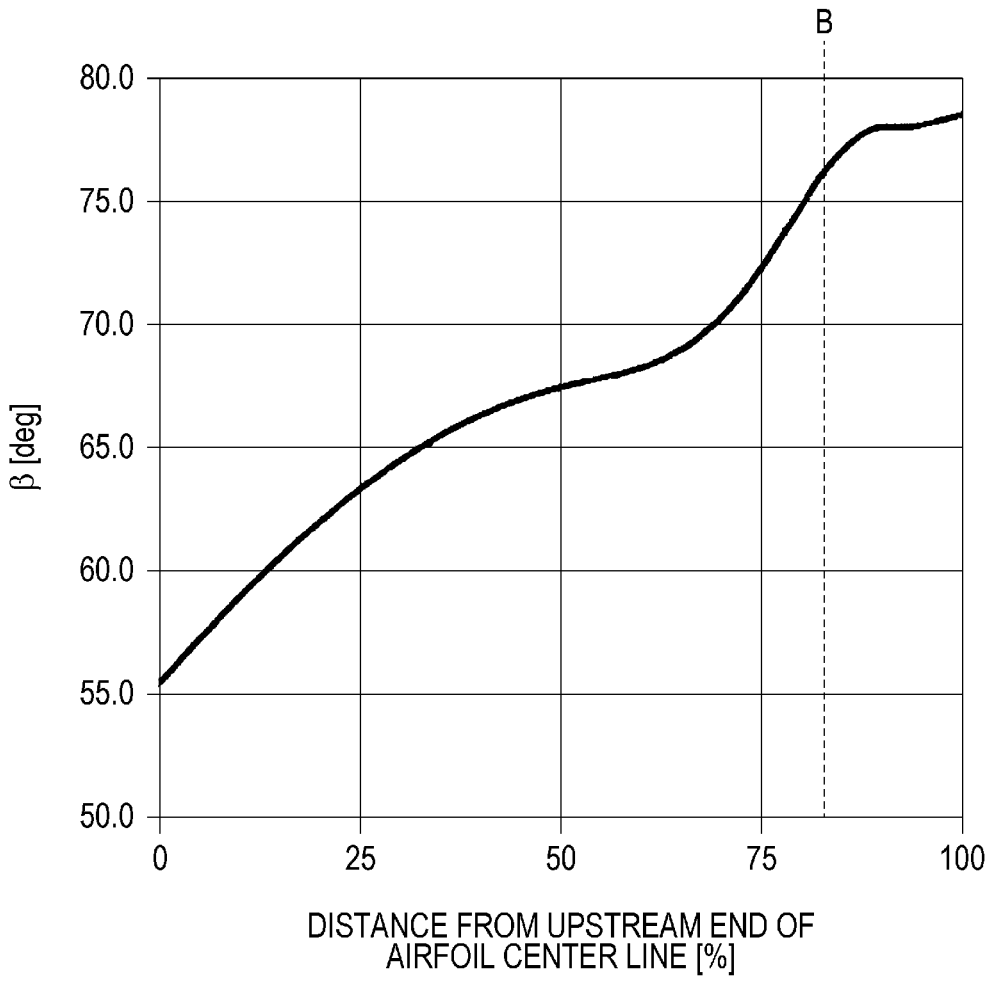
FIG. 8A is a graph illustrating an angle between a plane including a central axis and an airfoil center line in a nozzle vane in which Mach number M of a flow velocity at an outlet of the turbine nozzle reaches M=1.4.

For the nozzle vane 24 having the trailing edge portion 242 with a shape illustrated in FIG. 5(*a*), FIG. 8A is a graph illustrating a change in the angle β between a plane including the central axis O and the airfoil center line L. A horizontal axis thereof represents ratios of the distances from the upstream end Q1 of the airfoil center line L to the overall length of the airfoil center line L. A vertical axis thereof represents the angles β at positions on the airfoil center line L. As comprehensible from FIG. 8A, the average rates of change in the angle β are not uniform. According to such a structure, pressure fluctuations caused by the shock waves (compression waves) that are generated on the trailing edge portion 242 are generated linearly toward the downstream side between the nozzle vanes 24 at an angle determined in accordance with an angle of the trailing edge portion 242. In the enlarged expansion region, a uniform distribution of the discharge velocities with respect to a width direction of the nozzle vane 24 is brought about. Thus the fluctuations in the angular velocity (torque fluctuations) per one revolution of the turbine wheel 10 are reduced, so that high-quality AC power can be generated by a generator connected to the radial turbine 100.

Effects described above can be enhanced by increase in degree of curvature (bend) at the boundary point B. The trailing edge portion 242 of the nozzle vane 24 illustrated in FIG. 5(*b*) is more sharply curved at the boundary point B than the trailing edge portion 242 of the nozzle vane 24 illustrated in FIG. 5(*a*). FIG. 5(*c*) illustrates the trailing edge portion of the nozzle vane illustrated in FIG. 5(*a*) and the trailing edge portion of the nozzle vane illustrated in FIG. 5(*b*), by superposing both the portions for comparison.

Figure 8B:
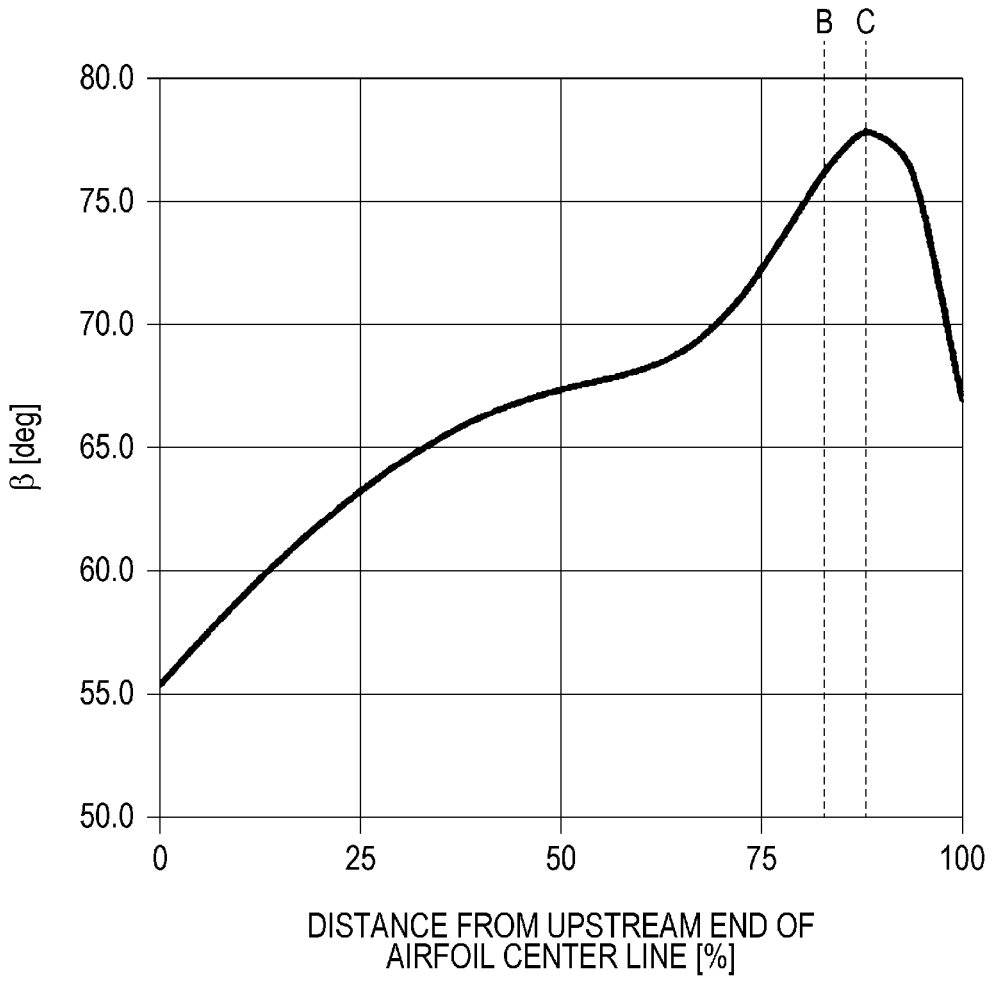
FIG. 8B is a graph illustrating an angle between a plane including the central axis and an airfoil center line in another nozzle vane in which the Mach number M of the flow velocity at the outlet of the turbine nozzle reaches M=1.4.

For the nozzle vane 24 having the trailing edge portion 242 with a shape illustrated in FIG. 5(*b*), FIG. 8B is a graph illustrating a change in the angle β between a plane including the central axis O and the airfoil center line L. As comprehensible from FIG. 8B, the airfoil center line L of the nozzle vane 24 having the shape of FIG. 5(*b*) is sharply curved at a second point C that is slightly nearer to the downstream end Q2 than the boundary point B is. In the first portion L1 of the airfoil center line L, the average rates of change in the angle β are positive values. The second portion L2 of the airfoil center line L includes the second point C where the average rates of change in the angle β change from positive values to negative values. At the second point C, monotonic increase in the angle β turns to monotonic decrease in the same. In other words, the average rates of change in the angle β change from positive values to negative values at the second point C. In a section from the second point C to the downstream end Q2, the average rates of change in the angle β are negative values. According to such a structure, effects described above can be further enhanced. In the embodiment, the boundary point B is different from the second point C. The boundary point B, however, may coincide with the second point C.

As illustrated in FIG. 8B, the angle β linearly changes in a section that includes the downstream end Q2 and that has a specified length. In the section from the second point C to the downstream end Q2, the average rates of change in the angle β are generally uniform (slopes are uniform). With the trailing edge portion 242 having such a structure, the expansion region can be enlarged as described above. A discharge angle of the working fluid from the turbine nozzle 14 is restricted so as not to be excessively deflected and thus the inlet angle of the working fluid into the turbine wheel 10 can be maintained at an appropriate value as designed. Consequently, efficiency of the radial turbine 100 is further increased.

In the embodiment, the thickness of the nozzle vane 24 starts to gradually decrease from a position slightly downstream of the intersection K described above. As illustrated in FIG. 4, specifically, a position that is on the airfoil center line L and that is at a distance of c % of the overall length of the airfoil center line L from the upstream end Q1 toward the downstream end Q2 of the airfoil center line L is defined as a position Pc (b<c<x). In an example of FIG. 4, the thickness of the nozzle vane 24 starts to decrease from a desired position included in a section from the position Pb to the position Pc toward the downstream end Q2 of the airfoil center line L. In an example, a setting of c=30 is made. In response to such change in the thickness, the throat 27*b* can be formed at an appropriate position.

Figure 9:
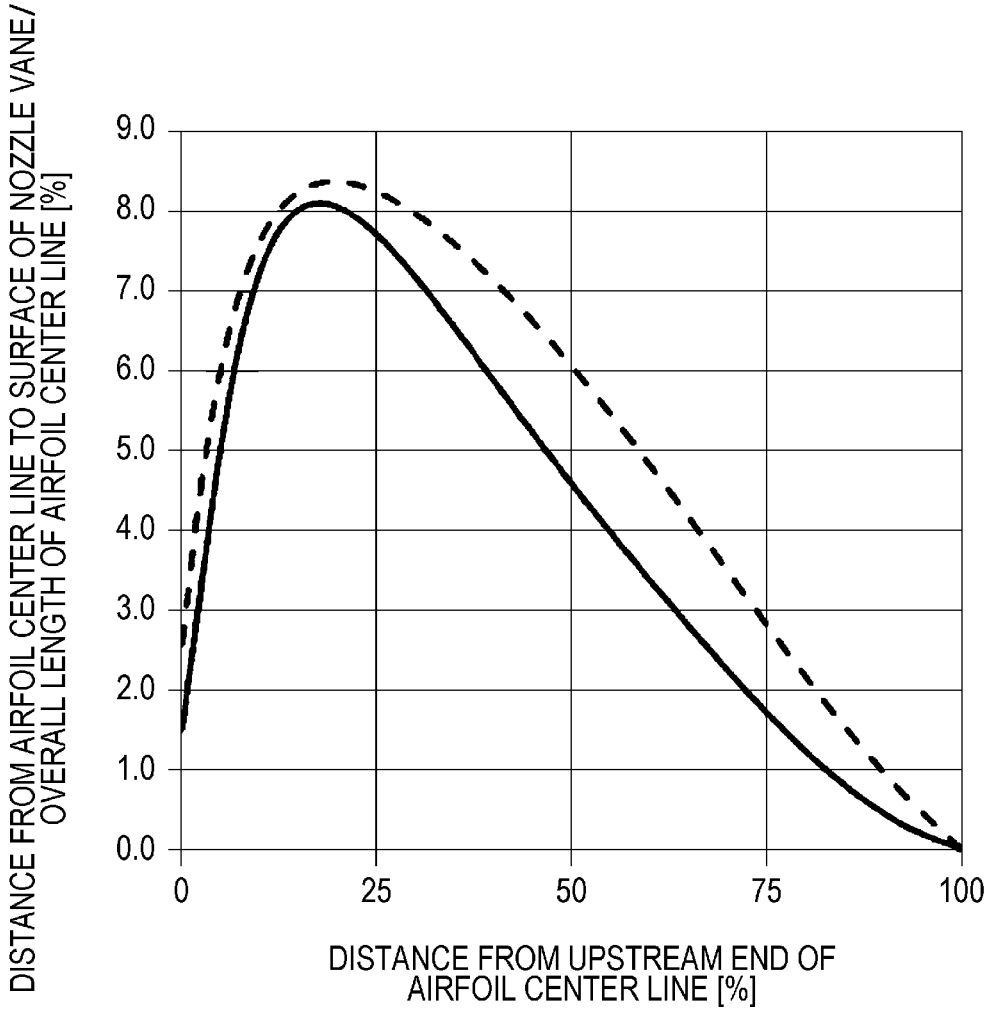
FIG. 9 is a graph illustrating an example of a distribution related to thicknesses of the nozzle vane.

FIG. 9 is a graph illustrating an example of a distribution related to the thickness of the nozzle vane 24 of FIG. 4. A horizontal axis thereof represents the ratios of the distances from the upstream end Q1 of the airfoil center line L to the overall length of the airfoil center line L. A vertical axis thereof represents ratios of distances from the airfoil center line L to surfaces of the nozzle vane 24 in a thickness direction of the nozzle vane 24 to the overall length of the airfoil center line L. In FIG. 9, a solid line designates the ratio related to the distance (first thickness) from the airfoil center line L to the back surface 24*q* in the thickness direction of the nozzle vane 24. In FIG. 9, a dashed line designates the ratio related to the distance (second thickness) from the airfoil center line L to the ventral surface 24*p* in the thickness direction of the nozzle vane 24. The thickness of the nozzle vane 24 at a desired position on the airfoil center line L is expressed as a sum of the first thickness and the second thickness. In the example of FIG. 9, the thicknesses of the nozzle vane 24 are maximized at a position that is at a distance of about 20% of the overall length of the airfoil center line L from the upstream end Q1 toward the downstream end Q2 of the airfoil center line L, that is, at the position Pa in case of a=20 or a position therearound. The thicknesses of the nozzle vane 24 evidently exhibit downward trends at a position (for instance, the position Pc with c=30) slightly downstream of the intersection K that exists between the position Pa with a=20 and the position Pb with b=25. The thicknesses of the nozzle vane 24 monotonically and gently decrease in a section from the position Pc to the downstream end Q2. In response to such change in the thicknesses, the throat 27*b* can be formed at an appropriate position.

Herein, a dimension of the nozzle vane 24 from a top surface 22*p* of the hub 22 to the top surface 24*r* of the nozzle vane 24 along a direction parallel to the central axis O of the hub 22 is defined as a height of the nozzle vane 24. The heights of the nozzle vane 24 on the downstream side of the throat 27*b* with respect to the flow direction are greater than the heights of the nozzle vane 24 on the upstream side of the throat 27*b* with respect to the flow direction. According to such a structure, the effects obtained from the Laval nozzle, such as the effect of cancelling out the shock waves, are enhanced. As a result, the expansion by a higher pressure ratio can be attained. Even after the Mach number M of the flow velocity of the working fluid reaches 1 at the throat 27*b*, the working fluid may continue increasing in velocity, that is, expanding. Thus an impulse component that rotates the turbine wheel 10 is increased because the working fluid having a higher velocity can be introduced into the turbine wheel 10 in comparison with a turbine nozzle in which a simple tapered nozzle is used and, consequently, the radial turbine 100 capable of generating large output power in the single stage can be constructed.

Figure 6A:
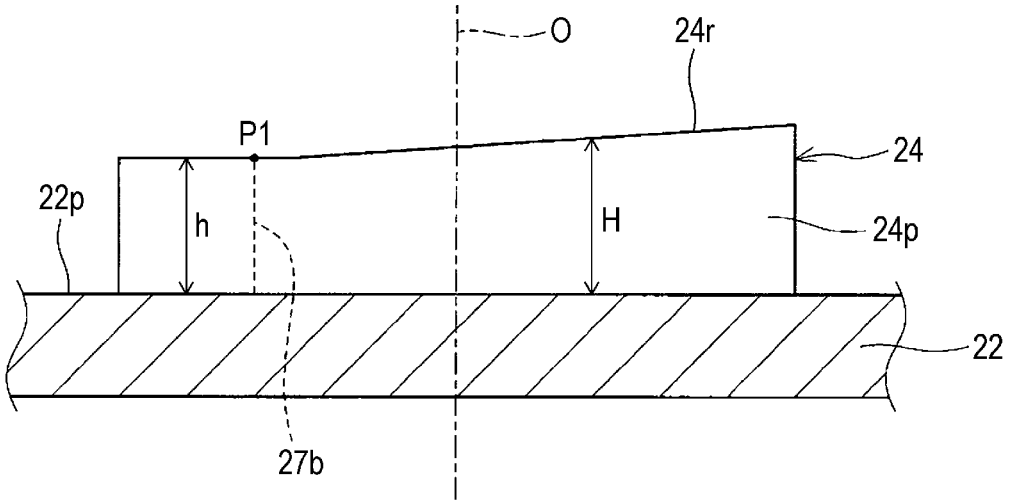
FIG. 6A is a sectional view of the turbine nozzle, taken along a center line of a flow path.
Figure 6B:
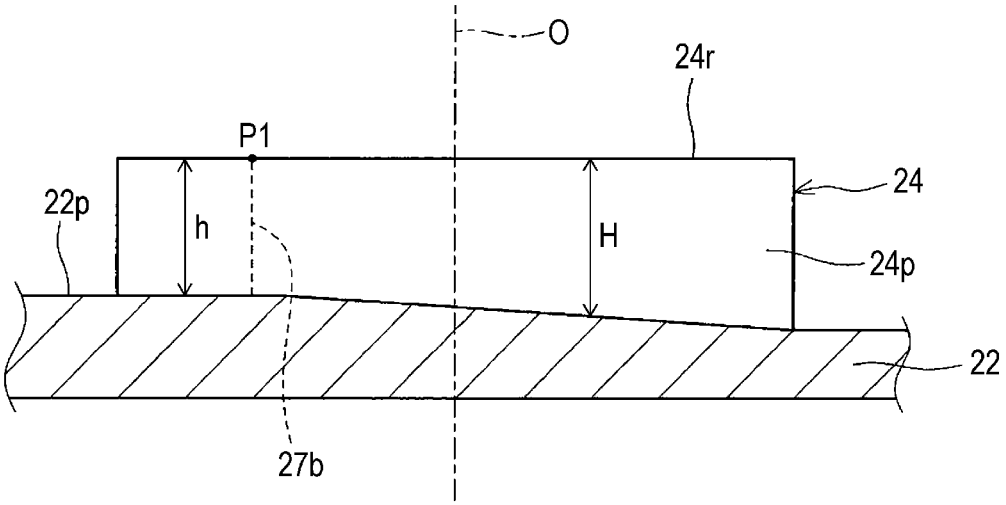
FIG. 6B is a sectional view of the turbine nozzle according to a modification, taken along the center line of the flow path.
Figure 6C:
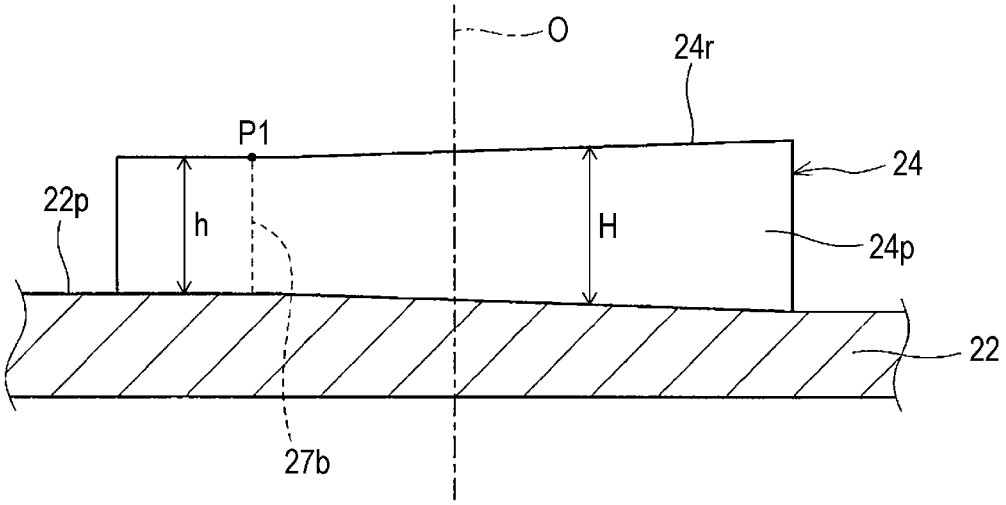
FIG. 6C is a sectional view of the turbine nozzle according to another modification, taken along the center line of the flow path.

As illustrated in FIGS. 6A to 6C, specifically, the height H of the nozzle vane 24 on the downstream side of the throat 27*b* with respect to the flow direction gradually increases from the upstream side toward the downstream side with respect to the flow direction. The heights H of the nozzle vane 24 on the downstream side of the throat 27*b* with respect to the flow direction are greater than the heights h of the nozzle vane 24 on the upstream side of the throat 27*b* with respect to the flow direction. According to such a structure, a change in the flow path cross-sectional area can be made to near the change in the Laval nozzle. As a result, the working fluid can be expanded more smoothly.

FIGS. 6A to 6C are sectional views of the nozzle vane 24 taken along a center line of the flow path 27 illustrated in FIG. 3. In FIGS. 6A to 6C, the ventral surface 24*p* of the nozzle vane 24 appears.

In an example illustrated in FIG. 6A, on the downstream side of the throat 27*b* with respect to the flow direction, the top surface 22*p* of the hub 22 is perpendicular to the central axis O of the hub 22 and the top surface 24*r* of the nozzle vane 24 is sloped relative to a plane perpendicular to the central axis O of the hub 22. In the example illustrated in FIG. 6A, thicknesses of the hub 22 with respect to a direction parallel to the central axis O are uniform. The uniform thickness of the hub 22 facilitates machining for production of a shape illustrated in FIG. 6A.

In an example illustrated in FIG. 6B, on the downstream side of the throat 27*b* with respect to the flow direction, the top surface 24*r* of the nozzle vane 24 is perpendicular to the central axis O of the hub 22 and the top surface 22*p* of the hub 22 is sloped relative to a plane perpendicular to the central axis O of the hub 22. In this example, the thickness of the hub 22 changes along the nozzle vane 24. On the downstream side of the throat 27*b* with respect to the flow direction, the thickness of the hub 22 is decreased. According to the example illustrated in FIG. 6B, the top surface 24*r* of the nozzle vane 24 is parallel to a plane perpendicular to the central axis O and thus a dimension of a clearance between the nozzle vane 24 and the shroud wall 16 (see FIG. 1) can be easily adjusted. That is, it is not requisite to modify a shape of the shroud wall 16 and increase in production costs for the turbine nozzle 14 can be reduced.

In an example illustrated in FIG. 6C, on the downstream side of the throat 27*b* with respect to the flow direction, the top surface 24*r* of the nozzle vane 24 is sloped relative to a plane perpendicular to the central axis O of the hub 22. In addition, the top surface 22*p* of the hub 22 is sloped relative to a plane perpendicular to the central axis O of the hub 22. This example is a combination of the example of FIG. 6A and the example of FIG. 6B. According to the example illustrated in FIG. 6C, a slope angle of the top surface 24*r* of the nozzle vane 24 and a slope angle of the top surface 22*p* of the hub 22 can be decreased.

Figure 10:
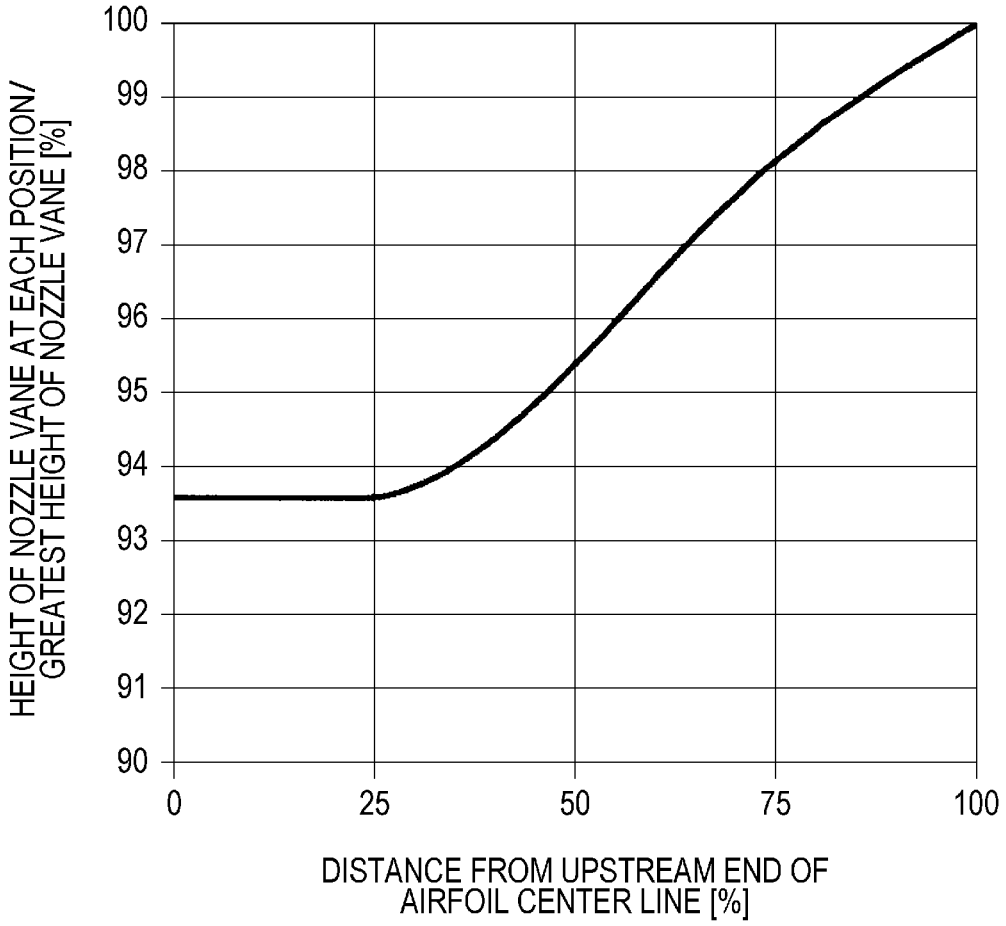
FIG. 10 is a graph illustrating a distribution of heights of the nozzle vane.

FIG. 10 is a graph illustrating a distribution of the heights of the nozzle vane. A horizontal axis thereof represents the ratio of the distance from the upstream end Q1 of the airfoil center line L to the overall length of the airfoil center line L. A vertical axis thereof represents a ratio of the height at each position to the greatest height. The height of the nozzle vane 24 at each position represents the height on the airfoil center line L. In the embodiment, the nozzle vane 24 has the greatest height at the downstream end Q2. The heights of the nozzle vane 24 are uniform in a section from the upstream end Q1 (0% position) to the position Pb. As described with reference to FIGS. 3 and 4, the position Pb is a position slightly downstream of the intersection K. The height of the nozzle vane 24 increases substantially linearly in a section from the position Pb to the downstream end Q2 (100% position). According to such a structure, the sharp pressure change is curbed on the downstream side of the throat 27*b*, so that the working fluid can be expanded more smoothly.

In the embodiment, a starting point of the divergent portion 27*c* is on the downstream side of the throat 27*b*. In the embodiment, the throat 27*b* has a certain length. That is, there is the section that has the smallest flow path cross-sectional area in the turbine nozzle 14 of the embodiment. In an example, the throat 27*b* has the length that is about 5% of the overall length of the airfoil center line L. The starting point of the divergent portion 27*c* is set at a position of a downstream end of the throat 27*b*. Boundary layers are formed on the surfaces of the nozzle vane 24 and thus flow of the working fluid is made the narrowest at a position downstream of a forefront position of the throat 27*b*. The starting point of the divergent portion 27*c* is determined in consideration of an above fact. The change in the flow path cross-sectional area is given by a shape of the airfoil center line L of the nozzle vane 24, the thicknesses of the nozzle vane 24 on a side of the ventral surface 24*p*, the thicknesses of the nozzle vane 24 on a side of the back surface 24*q*, and the heights of the nozzle vane. As a consequence of an above fact, the thickness of the nozzle vane 24 decreases from the position Pb slightly downstream of the intersection K and the height of the nozzle vane 24 increases from the position Pb slightly downstream of the intersection K.

Subsequently, an embodiment of a power generation system in which the radial turbine 100 is used will be described.

Figure 11:
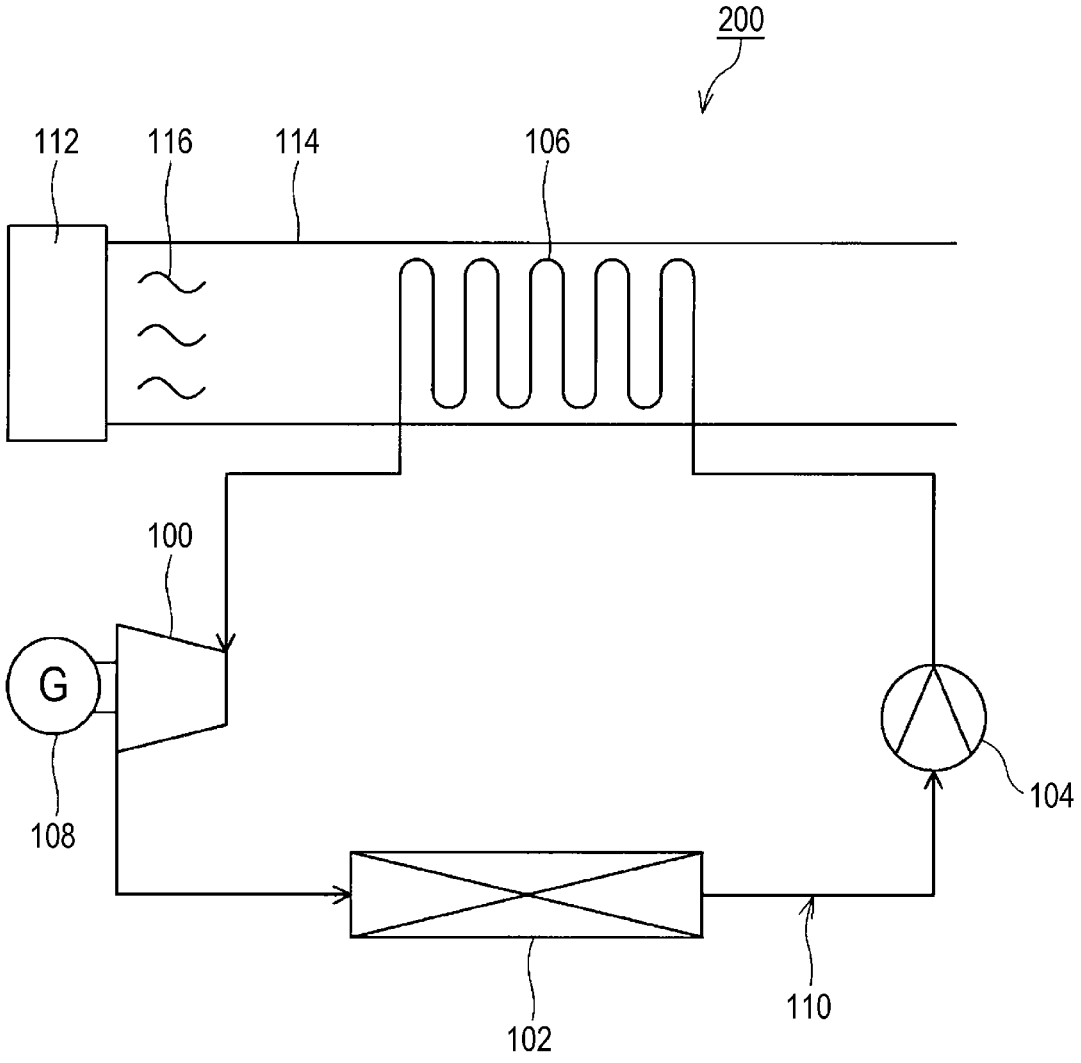
FIG. 11 is a configuration of a power generation system in which the radial turbine is used.

As illustrated in FIG. 11, the power generation system 200 according to the embodiment includes a Rankine cycle circuit 110, a heat source 112, and a duct 114. The Rankine cycle circuit 110 includes the radial turbine 100, a condenser 102 (steam condenser), a pump 104, and an evaporator 106 (steam generator). The radial turbine 100, the condenser 102, the pump 104, and the evaporator 106 are connected in order of mention by a plurality of pipes. A generator 108 is connected to a rotating shaft of the radial turbine 100. When working fluid is expanded by the radial turbine 100, the generator 108 is driven so as to generate power. The Rankine cycle circuit 110 may include other publicly-known devices such as a reheater.

The evaporator 106 is configured to carry out heat exchange between heat-transfer fluid 116 that is generated in the heat source 112 and the working fluid that is circulated through the Rankine cycle circuit 110 so as to evaporate the working fluid. In the embodiment, the evaporator 106 is placed in the duct 114. The duct 114 is connected to the heat source 112. The heat-transfer fluid 116 generated in the heat source 112 flows through the duct 114. The heat-transfer fluid 116 may be gas or may be liquid. In case where the heat-transfer fluid 116 is gas, the evaporator 106 may be made of a vapor heat exchanger such as a finned-tube heat exchanger. In case where the heat-transfer fluid 116 is liquid, the evaporator 106 may be made of a liquid-liquid heat exchanger such as a plate-type heat exchanger and a double-pipe exchanger, for instance.

A type of the heat source 112 is not particularly limited. As examples of the heat source 112, a boiler, facilities of a plant, an engine, a refuse incinerator, a solar pond, a fuel cell, and the like may be enumerated.

A type of the working fluid for the Rankine cycle circuit 110 is not particularly limited. The working fluid may be such an organic substance as hydrocarbon and halogenated hydrocarbon or may be such an inorganic substance as water, ammonia, and carbon dioxide. Propane and the like may be enumerated as the hydrocarbon. R410a, R22, R32, R245fa, and the like may be enumerated as the halogenated hydrocarbon.

Techniques disclosed herein are useful for radial turbines. The radial turbine is useful for power generation systems, for instance.

What is claimed is:

1. A turbine nozzle that is used in a radial turbine, the turbine nozzle comprising:

a ring-shaped hub that has a central axis;

a plurality of nozzle vanes that are arranged at equal angular intervals on the hub along a circumferential direction of the hub, the plurality of nozzle vanes including a first nozzle vane and a second nozzle vane which adjoin along the circumferential direction of the hub; and a flow path that is formed between a ventral surface of the first nozzle vane and a back surface of the second nozzle vane, wherein, provided that a direction from an outer peripheral side of the hub toward an inner peripheral side of the hub is defined as a flow direction of working fluid in the flow path, the flow path includes a throat that has a smallest flow path cross-sectional area with respect to the flow direction, the flow path cross-sectional area increases on a downstream side of the throat with respect to the flow direction, and heights of the first nozzle vane on the downstream side of the throat with respect to the flow direction are greater than heights of the first nozzle vane in the throat and gradually increase from an upstream side toward the downstream side with respect to the flow direction, an airfoil center line of each of the plurality of nozzle vanes includes a first portion and a second portion, the first portion is a portion that extends from an upstream end of the airfoil center line to a first point, the first point being a point where the airfoil center line starts to curve in a direction toward the central axis, the second portion is a portion that extends from the first point to a downstream end of the airfoil center line, and provided that an angle formed by (1) a plane including the central axis and (2) the airfoil center line meeting at a point on the airfoil center line is defined as an angle β, average rates of change in the angle β when angles are obtained at points in the first portion by rotating the plane about the central axis so that the plane moves along the airfoil centerline from the upstream end to the first point are positive values, the second portion includes a second point where the average rates of change in the angle β change from positive values to negative values, and the average rates of change in the angle β when angles are obtained at points in a section from the second point to the downstream end by rotating the plane about the central axis so that the plane moves along the airfoil centerline from the second point to the downstream end are negative values.

2. The turbine nozzle according to claim 1, wherein a top surface of the hub on the downstream side of the throat with respect to the flow direction is perpendicular to the central axis and a top surface of the first nozzle vane on the downstream side of the throat with respect to the flow direction is sloped relative to a plane perpendicular to the central axis.

3. The turbine nozzle according to claim 1, wherein a top surface of the first nozzle vane on the downstream side of the throat with respect to the flow direction is perpendicular to the central axis and a top surface of the hub on the downstream side of the throat with respect to the flow direction is sloped relative to a plane perpendicular to the central axis.

4. The turbine nozzle according to claim 1, wherein a top surface of the first nozzle vane on the downstream side of the throat with respect to the flow direction is sloped relative to a plane perpendicular to the central axis and a top surface of the hub on the downstream side of the throat with respect to the flow direction is sloped relative to the plane perpendicular to the central axis.

5. The turbine nozzle according to claim 1, wherein the angle β linearly changes in a section in the second portion that includes the downstream end and that has a specified length.

6. A radial turbine comprising:

the turbine nozzle according to claim 1; and a turbine wheel that is placed on inside of the turbine nozzle.

* * * * *